United States Patent [19]

Francies, III

[11] Patent Number: 4,627,198

[45] Date of Patent: Dec. 9, 1986

[54] HOISTING ANCHOR ASSEMBLY FOR USE IN CAST CONCRETE PANELS AND METHOD

[75] Inventor: Sidney E. Francies, III, San Mateo, Calif.

[73] Assignee: The Burke Company, San Mateo, Calif.

[21] Appl. No.: 651,282

[22] Filed: Sep. 17, 1984

[51] Int. Cl.[4] ..... E04B 21/2

[52] U.S. Cl. ..... 52/125.5; 52/699; 294/89; 264/256

[58] Field of Search ..... 52/124.2, 125.4, 125.5, 52/699–714; 294/89; 264/253, 256, 254

[56] References Cited

U.S. PATENT DOCUMENTS

| | | | |
|---|---|---|---|
| 923,188 | 6/1909 | Kneas | 52/699 |
| 1,072,361 | 9/1913 | Rickman | 52/706 X |
| 3,181,276 | 5/1965 | Ballou | 52/125.5 X |
| 3,861,106 | 1/1975 | Erhart | 52/125.4 X |
| 4,173,856 | 11/1979 | Fricker | 52/125.5 |
| 4,367,892 | 1/1983 | Holt | 52/125.5 |

FOREIGN PATENT DOCUMENTS

| | | | |
|---|---|---|---|
| 2161269 | 6/1973 | Fed. Rep. of Germany | 52/125.5 |
| 43072 | 1/1966 | German Democratic Rep. | 52/125.4 |

*Primary Examiner*—John E. Murtagh
*Assistant Examiner*—Richard Chilcot
*Attorney, Agent, or Firm*—Limbach, Limbach & Sutton

[57] ABSTRACT

A hoisting anchor assembly to be embedded in a cast panel member of the type used as prefabricated building components. The anchor assembly includes an anchor head for receiving a hoisting unit such as a lifting shakle. The anchor head is retained within the panel member by an anchor in the form of an arcuate rod having a 180 degree bend with both ends of the rod being rigidly secured to the anchor head. The panel member is fabricated by horizontally casting a bottom panel section and positioning at least two of the anchor assemblies over the bottom panel section in a spaced-apart relationship with the anchor heads being disposed adjacent the position where the end of the panel section will be formed. A top panel section and a plurality of spaced-apart web sections are then cast over the bottom panel section, with the anchor assemblies being embedded in the web sections. A portion of the web sections are then removed so as to expose the anchor heads so that hoisting units may be attached to the recessed heads.

11 Claims, 6 Drawing Figures

HOISTING ANCHOR ASSEMBLY FOR USE IN CAST CONCRETE PANELS AND METHOD

TECHNICAL FIELD

The present invention relates generally to hoisting attachments and, more particularly, to an anchor assembly to be embedded in a cast concrete panel to be used in conjunction with a hoisting shackle for lifting the panel.

BACKGROUND ART

Prefabricated cast concrete panels are commonly used in constructing buildings and the like. Such panels may be fabricated at a manufacturing facility utilizing well-known continuous casting processes and shipped to the building site for installation.

Referring now to the drawings, FIG. 1 depicts a commonly-used, hollow cast concrete panel member, generally designated by the numeral 10. The panel member is fabricated by first horizontally casting a bottom panel section 12 at a first assembly station. Next, while the bottom panel section is still uncured, vertical spaced-apart web sections 14 are continuously cast over the bottom panel section 12.

Such casting is typically accomplished using slip forms which define the web sections. Simultaneously, gravel is poured into the regions between the slip forms where voids 20 in the panel are to be formed and over the bottom panel section 12. Finally, the concrete is poured over the webs and gravel to form a top panel section 16. The gravel serves to support the top panel section 16 until the section has cured. Curing is typically accomplished utilizing steam or other methods. The continuously cast panel member is then cut to the desired length.

Inasmuch as the panel member is quite heavy, it is necessary to use cranes and the like for maneuvering and positioning the panel. Preferably, anchor assemblies are inserted into the panel members during the casting process. The embedded anchor assemblies are then used for purposes of tilting up or otherwise hoisting the panel member.

The prior art anchor assemblies are fabricated from metal reinforcing bars (rebar). The assemblies include a pair of spaced-apart curved rod members 18 which are formed from a length of rebar which is bent 180 degrees to form a U-shaped member which is typically approximately two feet in length. The curved rod members 18 are connected together by at least three transverse cross-rod members 21 which are welded to the lower half of the curved rod members 18. The curved rod members, which are supported in a vertical position by the cross-rod members, must be spaced apart a distance so as to coincide with the spacing of the web sections 14 to be subsequently cast.

The prior art anchor assembly is embedded in the panel member during the casting process. First, the bottom panel section 12 is cast, as previously described. Next, the anchor assembly is positioned over the bottom panel section, with the lower portion of the curved rod members and the cross-rod members providing support on the surface of the uncured concrete. The assembly is positioned such that the vertical curved rod members 18 will coincide with the locations where the web sections 14 will be cast, as previously described. Next, the slip forms are positioned over the bottom panel section 12 and gravel is deposited where the voids 20 in the panel member are to be located. The web sections are then cast, followed by the casting of the top panel section 16.

Once the panel member 10 has cured, the member is cut to the desired length. The cut will be approximately ½ inch from the bent ends of the curve rod members 18. Preferably, some means of marking is used during the casting process so that the imbedded rod members can be located. A chisel or other chipping tool is then used to remove a portion of the proximate ends of the web sections 14 so as to expose the curved portion of the two rod members 18.

The proximate ends of the exposed portion of the curved rod members are recessed within the panel member 10 by approximately ½ inch so as not to interfere with the installation of the panel member in a building. It is not possible to apply a hoisting shackle directly through the loop formed in the curved rod member 18 since the shackle will have a tendency to damage the panel member in the area of the loop. Accordingly, a strongback, generally designated by the numeral 22, must be used. Strongback 22, which has an L-shaped cross-section, is fabricated from heavy guage metal.

The strongback is secured to the curved rod members 18 using a pair of hooked members 26. The hooked members have a curved section which extends through the loop formed in rods 18, and a threaded section which extends through corresponding openings 24 formed in the face of the strongback 22. Nuts 28 are then positioned over the threaded ends of hooked members 26 and tightened thereby rigidly securing the strongback to the anchor assembly embedded in the panel member. The strongback is provided with a pair of metal shackles 30 which are then used in conjunction with a hoisting shackle for lifting the panel member. Once the panel member is in place, nuts 28 are loosened and the strongback is removed.

The previously-described prior art anchor assembly possesses several shortcomings. First, it is necessary to match the spacing of the curved rod members 18 with the position of the web sections 14. Thus, flexibility is significantly reduced with respect to the construction of the anchor assembly and with respect to the positioning of the webs 14 of the panel.

In addition, the relatively large size of the anchor assembly and the limitations on the position of the assembly frequently interfere with the placement of other types of embedded inserts and tension cables. Perhaps most importantly, the prior art anchor assembly requires the use of a strongback. Accordingly, a substantial amount of time and labor is required to install and remove the strongback.

The subject invention overcomes the above-described limitations of the prior art anchor assemblies. The subject invention allows the panel webs 14 to be spaced wherever desired, and does not significantly interfere with the positioning of other types of inserts. Furthermore, a lifting shackle may be attached directly to the subject anchor assembly, thereby obviating the requirement that a strongback be used. These and other advantages of the subject invention will become apparent to those skilled in the art upon a reading of the following Best Mode of Carrying Out the Invention together with the drawings.

DISCLOSURE OF THE INVENTION

An anchor assembly to be embedded in a cast panel member is disclosed. The assembly includes an anchor head means for receiving a hoisting unit such as a hoisting shackle/clutch ring combination. The assembly is further provided with an anchoring means for anchoring the anchor head means in the panel. The anchoring means is preferably in the form of a curved metal rod having a 180 degree bend, with the ends of the rod being rigidly secured to the anchor head means.

The panel member is fabricated by horizontally casting a bottom panel section and positioning at least two of the anchor assemblies on top of the bottom panel section in a spaced-apart relationship. Next, an upper panel section and intermediate spaced-apart vertical web sections are cast over the bottom panel sections and the anchor assemblies. The anchor assemblies are embedded in the web sections, with the anchor head means being positioned near the edge of the panel member. Finally, a portion of the cast web members is removed so as to provided access to the anchor head means so that a hoisting apparatus may be coupled to the anchor assembly.

BEST MODE FOR CARRYING OUT THE INVENTION

Figure 2:
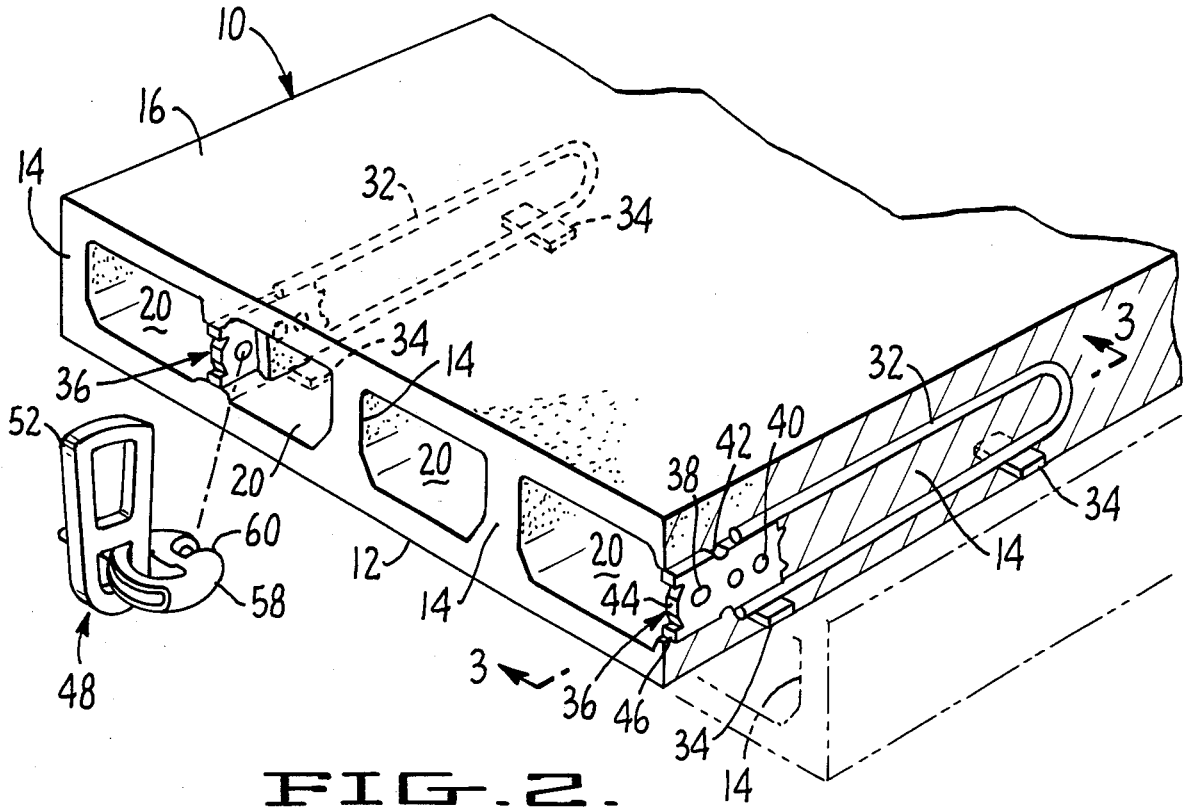
FIG. 2 is a perspective view of a portion of a cast panel member with a pair of the subject anchor assemblies installed.

Referring again to the drawings, FIG. 2 shows an exemplary cast panel member, generally designated by the numeral 10, having two of the subject anchor assemblies embedded in web section 14 thereof. As perhaps can best be seen in FIG. 3, each anchor assembly includes a U-shaped curved rod member 32 which is fabricated from a length of steel round bar typically approximately ½ inch in diameter and four feet in length. The round bar is bent 180 degrees to form the U-shape and is roughly two feet in length and three inches in height. A pair of float plates 34 are secured to the underside of the curved rod member 32 at opposite ends thereof. As will be subsequently explained, plates 34 serve to support the curved rod member 32 in a vertical position on the surface of uncured bottom panel section 12 until the web sections 14 are cast.

The anchor head of the assembly, generally designated by the numeral 36, is preferably fabricated from steel flat bar stock approximately 7½ inches in length, 2½ inches in width, and ⅝ inches thick. Head 36 is provided with an elongated eyelet 38 which is centrally disposed near the proximate end of the anchor head. Opposing notches 42 and openings 40 are also formed in the anchor head to accept rebar and the like or additional inserts.

A recess 44 is formed in the proximate end of the anchor head so as to create a pair of opposing protruding members 46. Recess 44, intermediate members 46, defines three planar surfaces (not designated), including a pair of inclined or beveled surfaces disposed on opposite sides of a vertical surface. A main body section (not designated) of anchor head 36 is disposed between the proximate ends of curved rod member 32. The body section is welded to the rod member ends along the length of the section so as to form a rigid integral structure.

Figure 1:
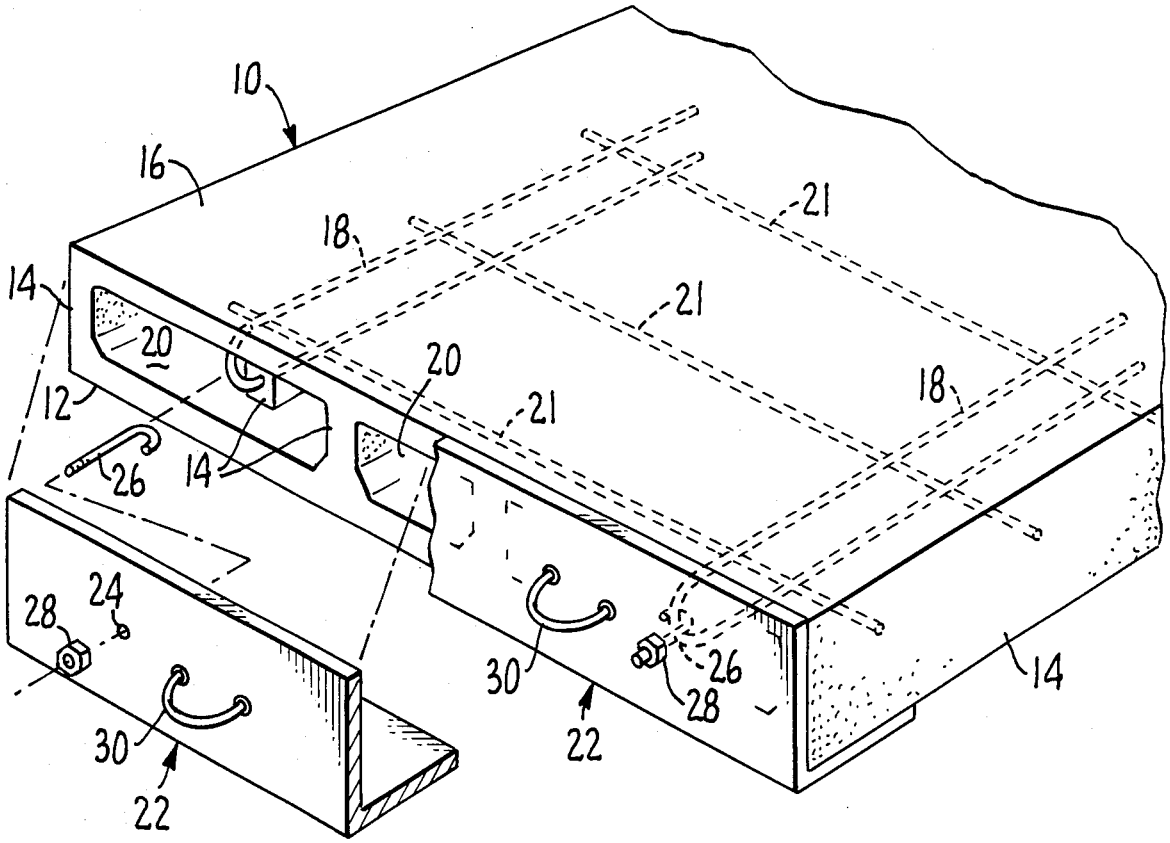
PRIOR ART FIG. 1.
FIG. 1 is a perspective view of a portion of a cast panel member with a prior art anchor assembly installed together with a bolt-on strongback.

Having described the construction of the subject anchor assembly, the manner in which the assembly is embedded in a cast panel member will now be described, together with the manner which the assembly is used in conjunction with a hoisting unit 48. The panel members in which the subject anchor assemblies are embedded are fabricated in a manner similar to that of the prior art process as described in connection with the FIG. 1 panel. First, a bottom panel section 12 is cast using conventional continuous casting techniques. Next, at least one, and preferably two, anchor assemblies are positioned on the upper surface of the uncured bottom panel section 12. Float plates 34 serve to support the assemblies on the uncured concrete and maintain the assemblies in the desired upright position.

The anchor assemblies are positioned on the bottom panel section 12 so as to coincide with web sections 14 to be cast. The proximate ends of the anchor heads 36 are located approximately ½ inch from the location where the panel will eventually be cut. Since the anchor assemblies are not secured to one another, there is no restriction on the placement of the web sections, as is the case with the prior art anchor assembly.

Once the anchor assemblies are in position, the web sections 14 are cast using slip forms. Again, gravel is poured into the voids between the slip forms so as to support the forms and the top panel section 16 which is then cast over the gravel and web sections.

When the cast panel member 10 has at least partially cured, the member is cut to the desired length. The panel member is cut approximately ½ inch from the proximate ends of the anchor heads. The locations of the embedded anchor assemblies have been previously noted so that the embedded assemblies may be easily located.

Figure 3:
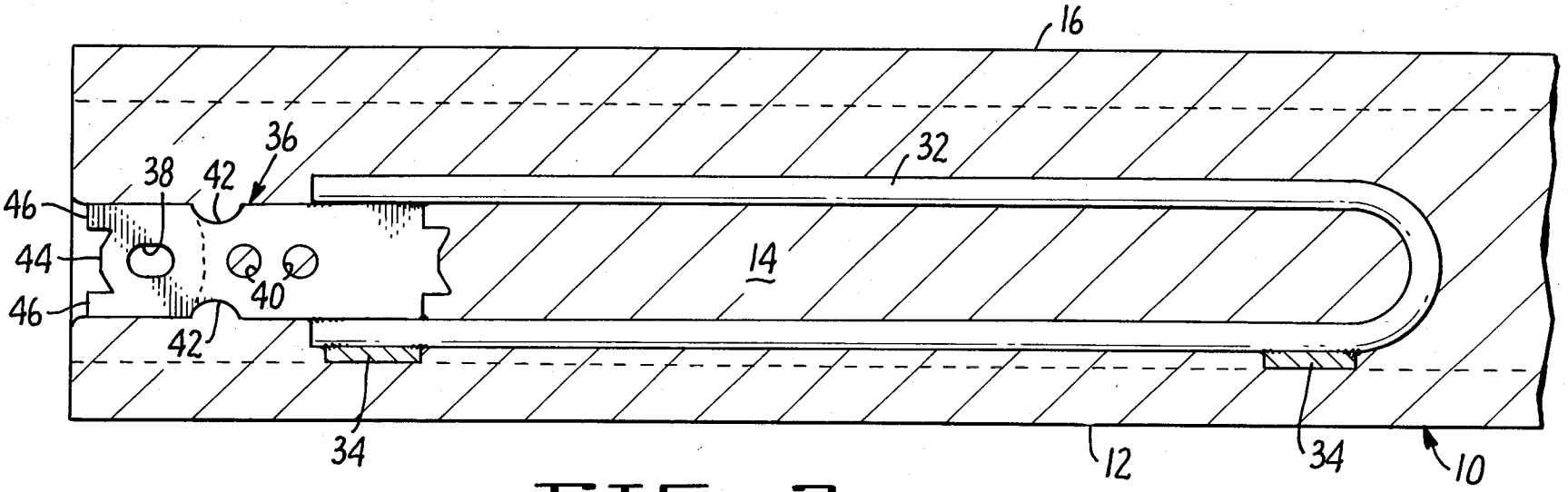
FIG. 3 is a sectional view taken through section line 3—3 of FIG. 2, showing further details of the subject anchor assembly.
Figure 4:
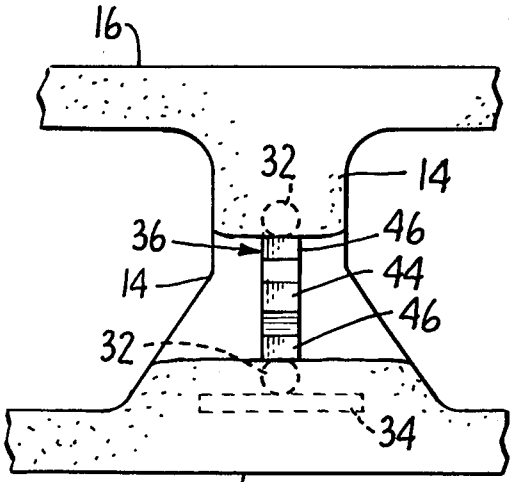
FIG. 4 is an elevational front view of a portion of the FIG. 2 panel member showing part of the exposed anchor head of one of the subject anchor assembly.

As perhaps can best be seen in FIGS. 3 and 4, a portion of the web section 14 is then removed from around each anchor head 36 so as to expose most of the head. Concrete is not removed from the portion of the web section disposed immediately above and below the anchor heads, so that the anchor head will be provided with additional support. Once the heads have been exposed, the panel may be lifted or tilted up using a conventional hoisting apparatus 48, which may be coupled directly to the heads. Thus, unlike the prior art anchor assemblies, it is not necessary to use a strongback or the like.

Figure 5:
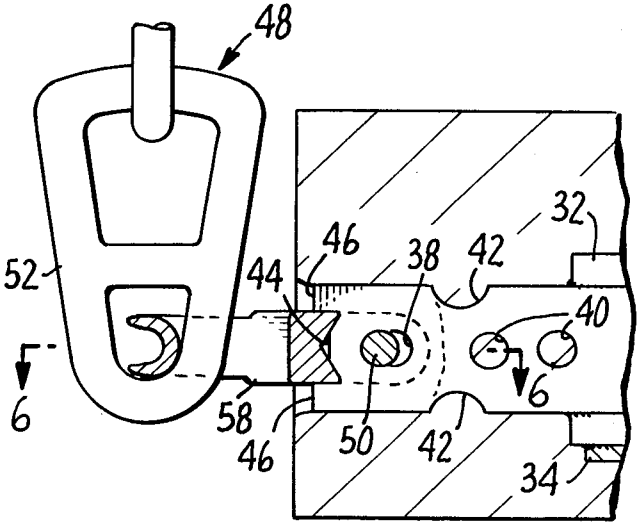
FIG. 5 is an elevational side sectional view of a portion of the FIG. 2 panel member showing a hoisting apparatus engaged with one of the anchor assemblies.
Figure 6:
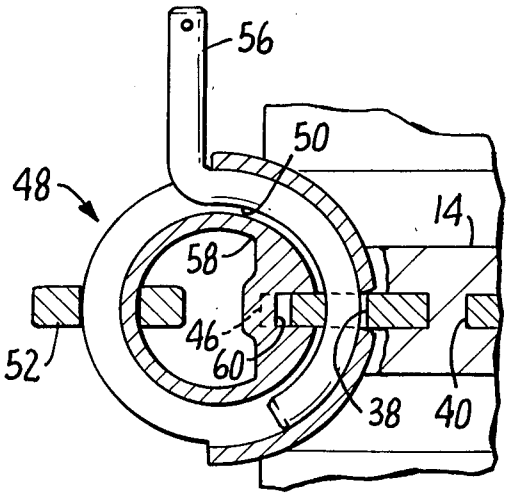
FIG. 6 is a partial cross-sectional view taken through section line 6—6 of FIG. 5.

FIGS. 5 and 6 illustrate the manner in which a conventional hoisting unit 48 may be coupled directly to the anchor heads of the subject anchor assemblies. Hoisting unit 48 typically include a shackle 52 which is coupled to a ring clutch. The clutch includes an annular clutch housing 58 which encloses a sliding semi-toroidal bolt 50. Housing 58 is provided with a mouth 60 for receiving the proximate end of the anchor head 36.

In operation, sliding bolt 50 is first rotated within housing 58 using an actuating lever 56 such that the bolt is free of the clutch housing mouth 60. Next, the ring clutch is inserted into the recess formed in the web section 14, with the anchor head being received within the clutch housing mouth 60. As shown in FIG. 5, a section of the clutch housing is disposed in recess 44 of the anchor head, with the protruding members 46 extending above and below the housing. The clutch housing is provided with a pair of inclined surfaces which abut corresponding inclined surfaces on the anchor head.

Actuating lever 56 is then rotated to the position shown in FIG. 6, thereby causing the sliding bolt 50 to pass through eyelet 38 of the anchor head. With the hoisting unit 48 so secured to the anchor assembly, it is now possible to lift the cast panel member 10 vertically using conventional hoisting apparatus such as a crane. Since the ring clutch is locked in position with respect to the anchor head, the clutch will not have a tendency to rotate when a lifting force is applied to the clutch by shackle 52. Accordingly, the shackle will be held away from the periphery of the panel member 10, thereby preventing damage to the member. Curved rod members 32 serve to firmly anchor the assembly within the panel member.

Thus, a novel anchor assembly and method of embedding same in a panel have been disclosed. Although a preferred embodiment of the invention has been described in some detail, it is to be understood that various changes can be made by persons skilled in the art without departing from the spirit and scope of the invention as defined by the appended claims.

What is claimed is:

1. An anchor assembly to be embedded in a cast panel member, said anchor assembly comprising:

anchor head means for receiving a hoisting unit;

anchoring means for anchoring said anchor head means in the panel member, said anchoring means including an arcuate elongated member having an outside bottom surface and first and second ends rigidly secured to said anchor head means; and support means for supporting said elongated member in a first plane, said support means including at least one plate fixed to the outside bottom surface of said elongated member and extending generally transverse to said first plane.

2. The anchor assembly of claim 1 wherein said anchoring means includes an elongated member having an approximately 180 degree bend.

3. The anchor assembly of claim 2 wherein said elongated member is a metal rod.

4. The anchor assembly of claim 3 wherein said anchor head means includes recess means for limiting rotational movement between said anchor head means and the hoisting unit.

5. The anchor assembly of claim 4 wherein said recess means includes a pair of spaced-apart protruding members which receive a portion of the hoisting unit therebetween.

6. The anchor assembly of claim 1 wherein said support means comprise a pair of parallel and spaced-apart plates fixed to the outside bottom surface of said elongated member.

7. An anchor assembly to be embedded in a cast panel member together with at least one other of said anchor assemblies, said anchor assembly comprising:

anchor head means for receiving a hoisting unit, said means being generally planar and including recess means for limiting rotational movement between said anchor head means and the hoisting unit;

anchoring means for anchoring said anchor head means in the panel member, said anchoring means including an elongate rod member rigidly secured to said anchor head means and having an outside bottom surface, said anchoring means being disposed within a plane generally coplanar with that of the anchor head means and including at least one portion extending in oblique relationship to the elongate rod member within said plane; and support means for supporting said anchor assembly, independent of said at least one other of said assemblies, in a fixed position during casting of the panel member said support means including at least one plate fixed to the outside bottom surface of said elongate rod member and extending generally transverse to the plane within which the anchoring means is disposed.

8. A method of fabricating a horizontally-cast panel member having bottom and top panel sections and a plurality of intermediate vertical web sections, and having embedded in the member a plurality of anchor assemblies, said method comprising the following steps:

providing a plurality of anchor assemblies, with each assembly including anchor head means for anchoring said anchor head means in the panel member;

casting said bottom panel section;

floating said plurality of anchor assemblies on said bottom panel section in a spaced-apart relationship prior to curing said bottom panel section while supporting each of said anchor assemblies in a vertical position, independent of other ones of said anchor assemblies;

casting said web and said top panel sections over said bottom panel section and said anchor assemblies, with said anchor assemblies being embedded in said web sections; and removing a portion of said cast panel member so as to expose at least part of said anchor head means.

9. The method of claim 8 wherein said anchoring means includes an arcuate member defining a plane and having an outside bottom surface, said arcuate member having first and second ends which are secured to said anchor head means.

10. The method of claim 8 wherein said anchor assemblies each include at least one plate secured to the outside bottom surface of said arcuate member in a plane generally transverse to the plane defined by said arcuate member, with said plate used for floating and supporting said assembly in said vertical position.

11. An anchor assembly to be embedded in a cast panel member together with an spaced apart from at least one other of said assemblies, each said assembly comprising:

anchor head means for receiving a hoisting unit;

anchoring means for anchoring said anchor head means in said panel member, said anchoring means having a bottom and being generally disposed in a first plane; and support means secured to the bottom of said anchoring means for supporting said anchor head means independent of said at least one other assembly, said support means including at least one support member which lies substantially in a second plane orthogonal to said first plane.

* * * * *